United States Patent [19]

Kingham

[11] 4,169,356

[45] Oct. 2, 1979

[54] REFRIGERATION PURGE SYSTEM

[76] Inventor: Lloyd Kingham, 12161 Ferrari La., Garden Grove, Calif. 92641

[21] Appl. No.: 881,189

[22] Filed: Feb. 27, 1978

[51] Int. Cl.[2] ..... F25B 47/00; F25B 7/00; F25B 43/04

[52] U.S. Cl. ..... 62/85; 62/335; 62/475

[58] Field of Search ..... 62/85, 474, 475, 335

[56] References Cited

U.S. PATENT DOCUMENTS

| | | | |
|---|---|---|---|
| 2,321,964 | 6/1943 | Zieber | 62/475 |
| 2,450,707 | 10/1948 | Zwickl | 62/85 |
| 2,464,631 | 3/1949 | Zwickl | 62/475 |
| 2,586,454 | 2/1952 | Brandin | 62/335 |
| 2,986,894 | 6/1961 | Endress et al. | 62/85 |
| 3,131,548 | 5/1964 | Chubb et al. | 62/475 |
| 3,145,544 | 8/1964 | Weller | 62/85 |
| 3,230,729 | 1/1966 | Eber | 62/475 |
| 3,592,017 | 7/1971 | Lipman | 62/85 |
| 3,664,147 | 5/1972 | Blackman | 62/85 |
| 4,025,326 | 5/1977 | Leonard, Jr. | 62/335 |

*Primary Examiner*—Lloyd L. King
*Attorney, Agent, or Firm*—Gordon L. Peterson

[57] ABSTRACT

A refrigeration purge system comprising a purge drum coupled to receive purge gas from a primary refrigeration system. The purge gas includes a primary refrigerant component and a noncondensable component. The purge system also includes a secondary refrigeration system which uses a secondary refrigerant. The secondary refrigerant and the purge gas are passed in heat exchange relationship in the purge drum to condense the primary refrigerant component of the purge gas. The condensed primary refrigerant is then returned to the primary refrigeration system, and the noncondensable component is expelled from the purge drum.

16 Claims, 2 Drawing Figures

REFRIGERATION PURGE SYSTEM

BACKGROUND OF THE INVENTION

Refrigeration systems, such as building air conditioning systems, typically utilize fluorocarbon refrigerants, such as the refrigerants commonly known as 11 and 113. In the operation of many refrigeration systems, purge gas tends to collect in the upper regions of the condenser of the refrigeration system. The purge gas typically includes uncondensed primary refrigerant, a noncondensable component, such as air, and a condensable component, such as water. The condensable and noncondensable components are more likely to be present in refrigeration systems operating at a high vacuum because a high vacuum tends to draw air and moisture from the atmosphere into the refrigeration system.

One way to eliminate the purge gas is to vent it to the atmosphere. This cannot be done because the refrigerant gas is harmful to the environment. In addition, this would increase the cost of operating the refrigeration system because of the loss of refrigerant inherent in the venting process.

In an effort to solve this problem, it is known to feed the purge gas to a purge drum. The purge drum is a condenser in which at least some of the condensable component and the refrigerant component are condensed. The refrigerant component is then returned to the refrigeration system, the condensable component is bled from the purge drum and the noncondensable component is vented to the atmosphere.

In order to permit the purge drum to function as a condenser, it is necessary to supply it with a condensing or cooling medium. In the prior art, this cooling medium has taken the form of primary refrigerant from the primary refrigeration system or chilled water from the primary refrigeration system.

Unfortunately, none of these prior art techniques have condensed the refrigerant component to the extent desired. Consequently, when the noncondensable component is vented to the atmosphere, the uncondensed refrigerant also escapes to the atmosphere. Thus, prior art purge systems have not been as effective as desired in eliminating the environmentally harmful effects of venting the purge gas.

SUMMARY OF THE INVENTION

The present invention overcomes this problem by materially reducing the fraction of refrigerant component which escapes to the atmosphere. Accordingly, the detriment to the environment and the operating cost of the refrigeration system are both reduced.

With the present invention, the purge gas from the primary refrigeration system is fed to a purge drum. A secondary refrigeration system cools a secondary refrigerant, and this secondary refrigerant is also conducted to the purge drum. In the purge drum, the purge gas and the secondary refrigerant are passed in heat exchange relationship to condense at least a substantial portion of the primary refrigerant component of the purge gas.

In the purge drum of this invention, a substantially greater portion of the primary refrigerant component of the purge gas is condensed. Consequently, when the noncondensable component is vented, only a relatively small portion, if any, of the primary refrigerant escapes to the atmosphere.

One reason why the secondary refrigeration system is more effective in condensing the primary refrigerant component is that the secondary refrigerant can be made significantly colder than the chilled water or the primary refrigerant used for condensation purposes in the prior art purge systems. For example, the chilled water can obviously not drop below 32 degrees F. or it will freeze. Similarly, the primary refrigerant typically is not cooled below 25 degrees F. for otherwise it may freeze the water in the water chiller which typically forms a portion of the primary refrigeration system. Moreover, the temperature of the primary refrigerant will vary with the demand on the refrigeration system.

By utilizing a secondary refrigeration system, the secondary refrigerant can be cooled to a much lower temperature and, hence, more complete condensation of the primary refrigerant component of the purge gas is obtained. If the secondary refrigerant is too cold, it may freeze and, if it is too warm, it does not condense the primary refrigerant component sufficiently. Preferably, the secondary refrigerant is cooled to a temperature of about 5 degrees F. to about 25 degrees F. with a temperature of approximately 10 degrees F. being preferred for at least some applications.

Another advantage of using the secondary refrigeration system is that the purge system can operate when the primary refrigeration system is not operating. With the prior art purge systems which utilize the chilled water or primary refrigerant from the primary refrigeration system, the purge system cannot operate when the refrigeration system is shut down.

The purge system of this invention can be used in lieu of the prior art purge systems, in which event, the purge drum may be coupled to receive the purge gas directly from the condenser or other component of the primary refrigeration system. Alternatively, the purge system of this invention can be retrofit on existing systems. In this event, the purge drum of this invention may be coupled in series with the purge drum of the prior art purge system so that it receives the purge gas which would, but for this invention, be vented to the atmosphere. In either event, the purge system of this invention receives purge gas from the primary refrigeration system.

The purge system of this invention can be used with a primary refrigeration system that operates at either negative or positive pressure. However, it is particularly adapted for use with primary refrigeration systems, all or a portion of which operate at a negative pressure because these systems are more likely to draw in air and other noncondensables which must be vented from the system.

The secondary refrigeration system preferably operates at greater than atmospheric pressure at all locations in the system. This is useful in obtaining a secondary refrigerant temperature that is sufficiently low to provide the required condensation in the purge drum. Also, by operating at a positive pressure, it reduces the need for having to purge the secondary system.

The secondary refrigerant is conducted to a location at, or adjacent, the purge drum and it is at that point expanded to further cool the secondary refrigerant. The secondary refrigerant is cooled as it expands to a temperature which is colder than the primary refrigerant at any location in the primary refrigeration system. It is desirable to provide a heat exchanger for passing the secondary refrigerant enroute to the expanding means in heat exchange relationship with the condensed primary refrigerant enroute from the purge drum to the primary refrigerant system. This precools the secondary refrigerant and warms the primary refrigerant so that the latter is not too cold to be returned to the primary refrigeration system.

The purge drum includes a heat exchange path for the purge gas and the secondary refrigerant. It is desirable to maintain this path relatively uniformly cold. This prevents the formation of relatively warm regions along the heat exchange path which may tend to vaporize condensed primary refrigerant. To help accomplish this, the secondary refrigerant is preferably introduced to the purge drum at a plurality of spaced locations along the heat exchange path. This provides secondary refrigerant at the coldest temperature at multiple locations along the heat exchange path.

To further provide relative uniform coldness along the heat exchange path, the relatively warm secondary refrigerant which has passed in heat exchange relationship with the purge gas is also removed at multiple locations along the path. Thus, the heat exchange path includes a plurality of sections with each of the sections having an inlet and an outlet for the secondary refrigerant, and with the inlets of the sections being spaced and with the outlets of the sections being spaced. These sections can also be used to form baffles which define a portion of the heat exchange path along which the purge gas flows.

The invention, together with further features and advantages thereof, may best be understood by reference to the following description taken in connection with the accompanying illustrative drawing.

DESCRIPTION OF THE PREFERRED EMBODIMENT

Figure 1:
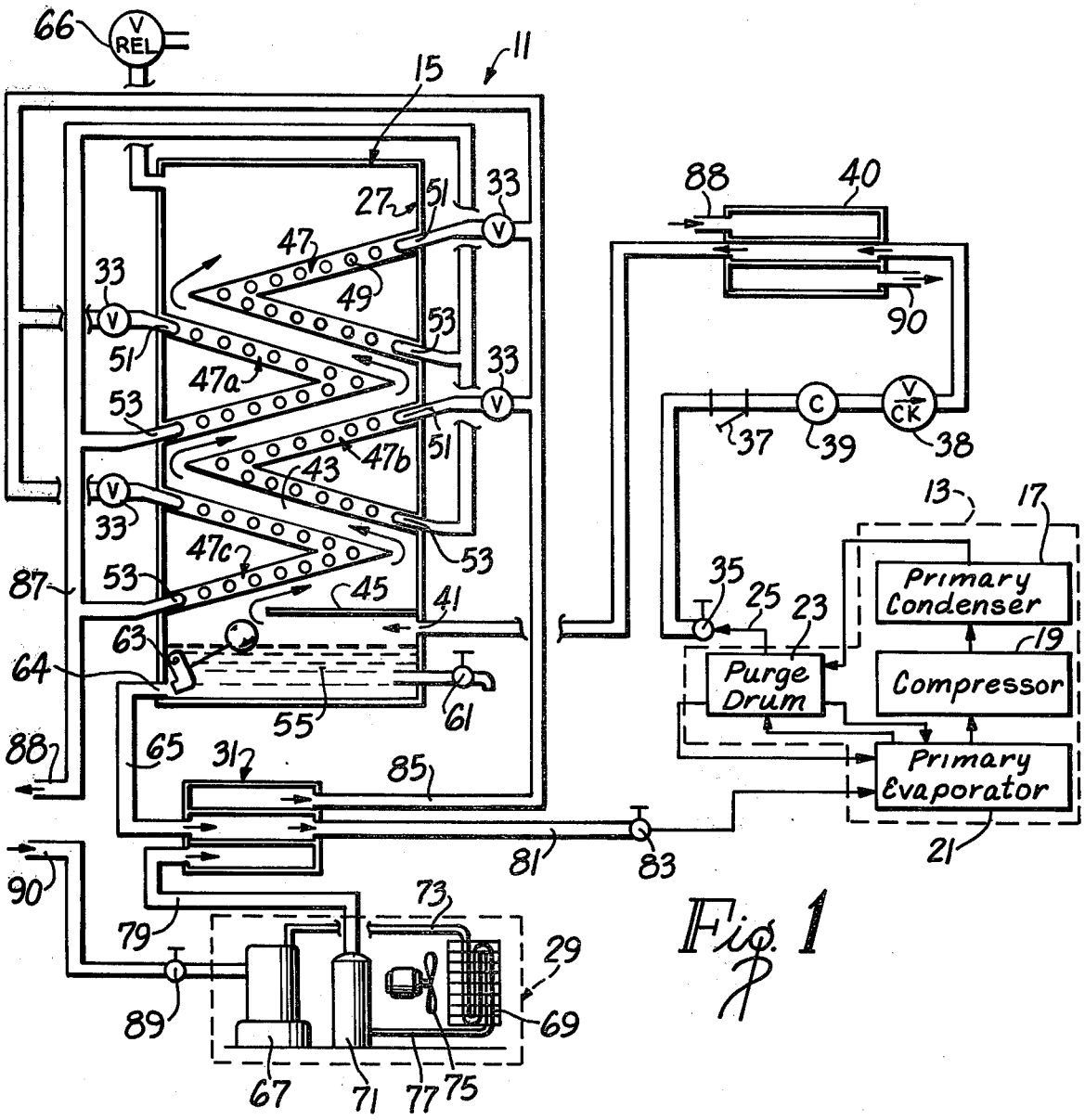
FIG. 1 is a schematic illustration partially in section of a refrigeration apparatus constructed in accordance with the teachings of this invention.

FIG. 1 shows a refrigeration apparatus 11 which generally includes a primary refrigeration system 13 and a purge system 15. The primary refrigeration system 13 is of conventional construction and includes, among other things, a primary condenser 17, a compressor 19, a primary evaporator 21, and a purge drum 23. All of the components of the primary refrigeration system 13 are interconnected in a well-known conventional manner to permit the primary refrigeration system to provide a suitable cooling or refrigeration function, such as air conditioning of an office building.

Briefly, primary refrigerant in the primary evaporator 21 cools water which is then used for air conditioning purposes. The warm primary refrigerant vapor is compressed by the compressor 19 and the compressed primary refrigerant gas is then fed to the primary condenser 17 where the majority of it is condensed and then returned to the primary evaporator 21 through an expansion device (not shown). In the embodiment illustrated, the entire primary refrigeration cycle operates at less than atmospheric pressure and consequently air and moisture from the atmosphere tend to be drawn in through any minute leaks in this equipment or the associated piping. Purge gas which includes uncondensed primary refrigerant, condensable gas, such as water, and noncondensable gases, such as air, collect in the upper regions of the primary condenser 17. This purge gas is fed to the purge drum 23 where it is passed in heat exchange relationship with chilled water from the primary evaporator 21. This condenses some of the primary refrigerant which is then returned to the primary evaporator 21. The chilled water which is warmed by the heat exchange in the purge drum 23 is returned to the primary evaporator 21. Other condensable gases, such as water, are bled from the purge drum 23 in a conventional manner. The remaining purge gas, which is not condensed and which is substantially free of moisture, is supplied by way of a conduit 25 to the purge system 15.

The purge system 15 includes a purge drum 27, a secondary refrigeration system 29, a heat exchanger 31 and one or more refrigerant expansion devices, such as expansion valves 33, and the several components between the purge drum 23 and the purge drum 27. The purge gas from the primary refrigeration system 13 passes through a shut-off valve 35 and a filter-drier 37 with moisture indicator to a compressor 39 where the purge gas is compressed and pumped through a check valve 38, a heat exchanger 40 and a gas inlet 41 to the lower regions of the purge drum 27. The filter-drier 37 is a conventional piece of equipment which removes any residual moisture from the purge gas. The purge gas is precooled in the heat exchanger 40 by secondary refrigerant from the secondary refrigeration system 29 which has passed through the purge drum 27.

Within the purge drum 27, the purge gas is passed along a path 43 where it is cooled by secondary refrigerant from the secondary refrigeration system 29 as described hereinbelow. Although the path 43 could be defined in different ways, in the embodiment illustrated, it is defined by a baffle 45 within the purge drum 27 and by a plurality of sections in the form of identical V-shaped panels 47, **47*a*, 47*b* and 47*c*. The panels 47–47*c* are arranged with the apex of every other panel pointing in the same direction and with the two legs of the panel 47*a* confronting legs of the panels 47 and 47*b*, respectively. The panels 47–47*c* define an elongated zig-zag path from a location adjacent the bottom of the purge drum 27 to a location adjacent the top of the purge drum. The side edges of the path 43 may be closed in various different ways, such as by the sides of the purge drum 27**.

Each of the panels **47–47*c* has a continuous elongated passage 49 winding back and forth therethrough from an inlet 51 adjacent the uppermost location of each of the panels to an outlet 53 adjacent the lowermost location of each of the panels. Thus, each of the panels 47–47*c* is supplied with cold secondary refrigerant which is not passed through any of the other panels. The path 43 over the majority of its length is defined by two confronting legs from different ones of the panels 47–47*c*. In each set of these confronting panel legs, one of the legs is supplied with relatively cold secondary refrigerant and the other of the legs has relatively warmer secondary refrigerant which has been heated by some of the purge gas. For example, the upper leg of the panel 47*b* is supplied directly with cold secondary refrigerant from its inlet 51, and the confronting leg of the panel 47*a* has relatively warmer refrigerant which has already passed through the upper leg of the panel 47*a*. Although temperature changes inherently occur along the path 43, the temperature is much more even than it would be if the primary refrigerant were supplied at a single location at the upper end of the panel 47** and passed through all of the panels before being removed from the lowermost location of the bottom panel 47c.

As the purge gas passes through the path 43, the primary refrigerant condenses to form a pool 55 of primary refrigerant at the bottom of the purge drum 27. If desired, liquid can be manually drained from the bottom of the purge drum 27 by a conventional manually operated blow-off valve 61. A conventional float operated valve 63 controls the discharge of the primary refrigerant from the pool 55 through an outlet 64 into a discharge conduit 65. The purge gas which is not condensed in the purge drum 27 is vented to the atmosphere through a relief valve 66.

The secondary refrigeration system 29 may be a conventional, small package refrigeration system. For example, the secondary refrigeration system 29 may include a compressor 67, a condenser 69 and a liquid receiver 71. The warm secondary refrigerant vapor is compressed by the compressor 67 and supplied by a conduit 73 to the condenser 69 where it is condensed by the air from a fan 75. The condensed secondary refrigerant is then supplied via a conduit 77 to the liquid receiver 71. The secondary refrigeration system 29 operates under positive pressure at all locations and may use, for example, refrigerant R22.

The secondary refrigerant from the receiver 71 and the condensed primary refrigerant from the purge drum 27 are supplied to the heat exchanger 31 via a conduit 79 and the conduit 65, respectively. The heat exchanger 31 passes the primary refrigerant and the secondary refrigerant in indirect heat exchange relationship. Because the primary refrigerant has been cooled in the purge drum 27, it is colder than the secondary refrigerant. Accordingly, the heat exchanger 31 precools the secondary refrigerant and heats the primary refrigerant so that its temperature is high enough to be safely returned to the primary evaporator 21. The primary refrigerant discharged from the heat exchanger 31 passes through a conduit 81 and a manual valve 83 to the primary evaporator 21.

The precooled secondary refrigerant is discharged from the heat exchanger 31 into a header 85 which leads to each of the four expansion valves 33. After passing through the expansion valves 33, the secondary refrigerant expands and, consequently, is cooled so that it enters the panels 47–47c at its lowest temperature. For example, the secondary refrigerant after passing through the expansion valves 33, may have a temperature in the range of from about 5 degrees F to about 25 degrees F. with about 10 degrees F being preferred. After passing through the panels 47–47c, the relatively warm secondary refrigerant passes through the associated outlets 53 to a header 87. From the header, the secondary refrigerant passes through a conduit 88 to the heat exchanger 40 and then through a conduit 90 and a manual valve 89 to the intake of the compressor 67.

It should be noted that the secondary refrigeration system 29 is totally separate from and independent of, the primary refrigeration system 13. The only relationship between the two refrigeration systems 13 and 29 is that their respective refrigerants pass in heat exchange relationship in the heat exchanger 31, and the secondary refrigerant is used to condense the purge gas from the primary refrigeration system.

Figure 2:
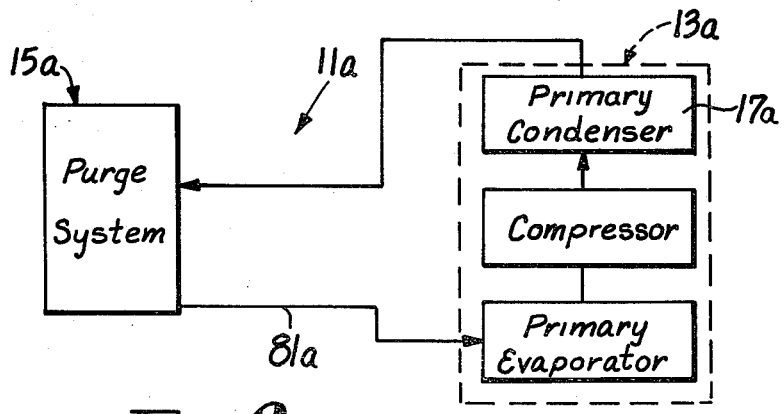
FIG. 2 is a schematic illustration of a second form of refrigeration apparatus constructed in accordance with the teachings of this invention.

FIG. 2 shows a refrigeration apparatus 11a which is identical to the refrigeration apparatus 11 in all respects, except that the purge drum 23 of FIG. 1 is eliminated and the purge system 15a is used as the sole purge for the primary refrigeration system 13a. Portions of the refrigeration apparatus 11a corresponding to portions of the refrigeration apparatus 11 are designated by corresponding reference numerals followed by the letter "a."Thus, in FIG. 2, the purge system 15a is coupled directly to the primary condenser 17 to receive the purge gas directly therefrom, and the purge gas does not pass through the purge drum 23 enroute to the purge system 15a.

Although exemplary embodiments of the invention have been shown and described, many changes, modifications and substitutions may be made by one having ordinary skill in the art without necessarily departing from the spirit and scope of this invention.

I claim:

1. A refrigeration apparatus comprising:

a primary refrigeration system of the type which is adapted to employ a primary refrigerant and in which purge gas accumulates which must be purged from the primary refrigeration system, said purge gas including a primary refrigerant component and a noncondensable component;

a purge drum;

first means for conducting the purge gas from the primary refrigeration system into the purge drum;

a secondary refrigeration system;

said secondary refrigeration system being adapted to employ a secondary refrigerant;

second means for conducting the secondary refrigerant from the secondary refrigeration system to the purge drum;

said purge drum including means for passing the purge gas and the secondary refrigerant in heat exchange relationship to condense at least a substantial portion of the primary refrigerant component of the purge gas;

means for returning the condensed portion of the primary refrigerant from the purge drum to the primary refrigeration system; and means for expelling the noncondensable component of the gases from the purge drum.

2. A refrigeration apparatus as defined in claim 1 wherein said primary refrigeration system operates at a negative pressure at least at one location in the primary refrigeration system and tends to draw in air from the atmosphere and such air forms at least a portion of said noncondensable component, and said secondary refrigeration system operates at a positive pressure and does not tend to draw in air from the atmosphere.

3. A refrigeration apparatus as defined in claim 1 wherein said primary refrigeration system includes purge means for removing some of the noncondensable component of the purge gas and for condensing some of the primary refrigerant component out of the purge gas, and said first means conducts the purge gas from the purge means to the purge drum.

4. A refrigeration apparatus as defined in claim 1 including means for expanding the secondary refrigerant to cool it and means for passing the secondary refrigerant enroute to said expanding means in heat exchange relationship with the condensed primary refrigerant enroute from the purge drum to the primary refrigeration system.

5. A refrigeration apparatus as defined in claim 1 wherein said purge drum includes a heat exchange path for the purge gas and the secondary refrigerant in the purge drum, said second means includes means for introducing the secondary refrigerant to said path at a plurality of spaced locations along said path whereby the temperature along said path to which the purge gas is subjected is made more uniform.

6. A refrigeration apparatus as defined in claim 1 wherein the secondary refrigeration system cools the secondary refrigerant to a temperature which is colder than the primary refrigerant at any location in the primary refrigeration system.

7. A refrigeration apparatus as defined in claim 1 wherein the primary refrigeration system operates at a negative pressure at least at one location in the primary refrigeration system and tends to draw in air from the atmosphere whereby such air forms at least a portion of said noncondensable component, said secondary refrigeration system operates at a positive pressure and does not tend to draw in air from the atmosphere, said second means includes means for expanding the secondary refrigerant to cool it, said refrigeration apparatus includes means for passing the secondary refrigerant enroute to the expanding means in heat exchange relationship with the condensed primary refrigerant enroute from the purge drum to the primary refrigeration system.

8. A method of purging a primary refrigeration system which uses a primary refrigerant wherein purge gas including a primary refrigerant component and a noncondensable component accumulate in the primary refrigeration system, said method comprising:

providing a secondary refrigeration system and a secondary refrigerant for the secondary refrigeration system;

cooling the secondary refrigerant using the secondary refrigeration system to a temperature colder than any temperature attained by the primary refrigerant in the primary refrigeration system to thereby provide cold secondary refrigerant;

passing the cold secondary refrigerant and the purge gas in heat exchange relationship to condense at least a substantial portion of the primary refrigerant component of the purge gas; and reusing the condensed portion of the primary refrigerant in the primary refrigeration system.

9. A method as defined in claim 8 wherein said step of cooling cools the secondary refrigerant to a temperature of from about 5 degrees F. to about 25 degrees F.

10. A purge system adapted to receive purge gas from a primary refrigeration system wherein the primary refrigeration system employs a primary refrigerant component and a noncondensable component, said purge system comprising:

a purge drum adapted for connection to the primary refrigeration system to receive the purge gas;

a secondary refrigeration system, said secondary refrigeration system being adapted to employ a secondary refrigerant;

means for conducting the secondary refrigerant from the secondary refrigeration system to the purge drum;

said purge drum including means for passing the purge gas from the primary refrigeration system and the secondary refrigerant in heat exchange relationship to condense at least a substantial portion of the primary refrigerant component of said purge gas;

means for expelling the noncondensable component of the purge gas from the purge drum; and outlet means on said purge drum for use in returning the condensed portion of the primary refrigerant to the primary refrigeration system.

11. A purge system as defined in claim 10 wherein said secondary refrigeration system operates at a pressure greater than ambient and does not tend to draw air into the secondary refrigeration system from the atmosphere.

12. A purge system as defined in claim 10 including means for expanding the secondary refrigerant to cool it and means for passing the secondary refrigerant enroute to the expanding means in heat exchange relationship with the condensed primary refrigerant enroute from the purge drum to the primary refrigeration system.

13. A purge system as defined in claim 10 wherein said purge drum includes a heat exchange path for the purge gas and the secondary refrigerant in the purge drum and said conducting means includes means for introducing the secondary refrigerant at a plurality of spaced locations along said path whereby the temperatures along said path to which the purge gas is subjected are made more uniform.

14. A purge system as defined in claim 13 wherein said heat exchange path includes at least first and second sections, each of said sections having an inlet for receiving the secondary refrigerant and an outlet for discharging the secondary refrigerant, said inlets being spaced from each other along said heat exchange path and said outlets being spaced from each other along said heat exchange path.

15. A purge system as defined in claim 14 wherein each of said first and second sections includes at least one baffle for directing the flow of purge gas along said heat exchange path.

16. A purge system as defined in claim 10 wherein the secondary refrigeration system cools the secondary refrigerant sufficiently so that the secondary refrigerant is at a temperature of from about 5 degrees F. to about 25 degrees F. for at least a portion of the time that it is passed in heat exchange relationship with the purge gas in the purge drum.

* * * * *